US007696137B2

(12) United States Patent
Yagishita

(10) Patent No.: US 7,696,137 B2
(45) Date of Patent: Apr. 13, 2010

(54) LUBRICATING OIL COMPOSITIONS

(75) Inventor: Kazuhiro Yagishita, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 453 days.

(21) Appl. No.: 11/058,636

(22) Filed: Feb. 15, 2005

(65) Prior Publication Data

US 2005/0143266 A1 Jun. 30, 2005

Related U.S. Application Data

(63) Continuation of application No. PCT/JP03/10756, filed on Aug. 26, 2003.

(30) Foreign Application Priority Data

Aug. 27, 2002 (JP) ..... 2002-246975
Jun. 11, 2003 (JP) ..... 2003-167095

(51) Int. Cl.
*C10M 137/04* (2006.01)
*C10M 141/10* (2006.01)

(52) U.S. Cl. ..... 508/371; 508/294; 508/368; 508/435

(58) Field of Classification Search ..... 508/294, 508/371, 368, 435
See application file for complete search history.

(56) References Cited

U.S. PATENT DOCUMENTS

| | | | | | |
|---|---|---|---|---|---|
| 2,849,397 | A | * | 8/1958 | Hotten | 508/379 |
| 3,634,239 | A | | 1/1972 | MacPhail et al. | |
| 3,779,928 | A | * | 12/1973 | Schlicht | 252/75 |
| 3,793,199 | A | * | 2/1974 | Schlicht | 508/436 |
| 3,872,186 | A | * | 3/1975 | Fenyes et al. | 558/198 |
| 4,158,633 | A | * | 6/1979 | Papay | 508/372 |
| 4,210,542 | A | * | 7/1980 | Mann | 508/286 |
| 4,329,162 | A | * | 5/1982 | Pitcher, Jr. | 55/523 |
| 4,612,129 | A | | 9/1986 | DiBiase et al. | |
| 5,262,076 | A | * | 11/1993 | Ishida et al. | 508/433 |
| 5,997,761 | A | * | 12/1999 | Kaneko | 252/68 |
| 6,127,323 | A | * | 10/2000 | Watts et al. | 508/291 |
| 6,586,375 | B1 | * | 7/2003 | Gahagan et al. | 508/244 |
| 6,730,640 | B2 | * | 5/2004 | Sowerby et al. | 508/371 |
| 6,764,982 | B2 | * | 7/2004 | Bardasz et al. | 508/293 |
| 2003/0220209 | A1 | * | 11/2003 | Curtis et al. | 508/551 |

FOREIGN PATENT DOCUMENTS

| | | | |
|---|---|---|---|
| EP | 0 083 124 | A1 | 7/1983 |
| EP | 0 234 923 | A2 | 9/1987 |
| EP | 0 280 579 | A2 | 8/1988 |
| EP | 0 308 651 | A2 | 3/1989 |
| EP | 0 785 247 | A1 | 7/1997 |
| EP | 1 277 145 | A1 | 7/2002 |
| EP | 1 516 911 | A1 | 3/2005 |
| GB | 2 017 748 | A | 10/1979 |
| JP | 39-6213 | B1 | 5/1939 |
| JP | 52-704 | | 1/1977 |
| JP | 62-501572 | A | 6/1987 |
| JP | 62-501917 | A | 7/1987 |
| JP | 62-253691 | A | 11/1987 |
| JP | 63-304095 | A | 12/1988 |
| JP | 01-500912 | A | 3/1989 |
| JP | 06-041568 | A | 2/1994 |
| JP | 09-241671 | A | 9/1997 |
| JP | 2002-294271 | A | 10/2002 |
| WO | WO 83/03616 | A1 | 10/1983 |
| WO | WO 86/06739 | A1 | 11/1986 |
| WO | WO 88/02771 | A1 | 4/1988 |
| WO | WO 96/11246 | A1 | 4/1996 |

* cited by examiner

*Primary Examiner*—Glenn Caldarola
*Assistant Examiner*—Jim Goloboy
(74) *Attorney, Agent, or Firm*—Panitch Schwarze Belisario & Nadel LLP

(57) ABSTRACT

A lubricating oil composition is disclosed which comprises a lubricating base oil, (A) at least one type of compound selected from specific phosphoric acid esters and salts thereof or in combination with (B) at least one type of compound selected from specific metal salts of specific phosphoric acid esters, with excellent oxidation stability, base number retention properties, anti-wear properties, extreme pressure properties and anti-corrosion properties and thus can be suitably used, in particular, as a lubricating oil for an internal combustion engine.

12 Claims, No Drawings

LUBRICATING OIL COMPOSITIONS

CROSS-REFERENCE TO RELATED APPLICATION

This application is a continuation of International Application No. PCT/JP2003/010756, filed Aug. 26, 2003, which was published in the Japanese language on Mar. 11, 2004, under International Publication No. WO 2004/020557 A1, the disclosure of which is incorporated herein by reference.

FIELD OF THE INVENTION

The present invention relates to lubricating oil compositions with excellent long drain properties and anti-wear properties, and more particularly to those of low phosphorus and sulfur type suitable for internal combustion engines.

BACKGROUND OF THE INVENTION

Lubricating oils have been used in internal combustion engines and automatic transmissions so as to facilitate the smooth operation thereof. Particularly, lubricating oils for internal combustion engines (engine oils) have been required to possess high characteristic performances due to the fact that recent developed engines have been improved in performances, increased in power output and used under more sever operation conditions and further to be improved in long-drain properties enabling the prolongation of oil drain intervals from the view point of recent environmental issues. Therefore, in order to fulfill such requirements, conventional engine oils are blended with various additives such as anti-wear agents, metallic detergents, ashless dispersants, and anti-oxidants so as to improve their characteristic performances. For example, attempts have been done wherein lubricating base oils are highly refined, synthetic oils such as poly α-olefin and polyolester are used, and anti-oxidation additives such as zinc dialkyldithiophosphates (ZDTP), phenol- and amine-based anti-oxidants and organic molybdenum compounds are optimized. Among these anti-oxidants, sulfur-containing additives such as ZDTP have been used as anti-oxidants and anti-wear agents which are indispensable additives for current lubricating oils, particularly for internal combustion engines.

Examples of ZDTP-free lubricating oils are known to include those containing zinc dialkyldithiocarbamates or sulfur-based additives, such as those disclosed in Japanese Patent Laid-Open Publication Nos. 52-704, 62-253691, 63-304095 and 6-41568 and Japanese Translations of PCT International Publication Nos. 62-501572, 62-501917 and 1-500912. The lubricating oils described in these publications contain sulfur in a large amount similarly to those containing ZDTP.

However, it now becomes apparent that there is a limit to further prolongation of life of a lubricating oil because these additives containing sulfur such as ZDTP possess anti-oxidation properties but release sulfuric acid in the process of their oxidation or thermal decomposition, which sulfuric acid accelerates the oxidation deterioration of the lubricating oil. A lubricating oil composition containing metallic detergents or ashless dispersants was likely to accelerate the decrement (deterioration) of the base number which is an index of acid neutralization properties.

Therefore, it is now necessary to reassess drastically the blend of additives with a central focus on anti-wear agents so as to produce a long-drain type lubricating oil with extremely excellent oxidation stability.

Furthermore, the lubricating oils with low sulfur, phosphorus and ash contents have been strongly demanded as a result of necessity to alleviate harmful influences on exhaust-gas purifying catalysts such as ternary catalysts, oxidation catalysts and NOx adsorbers, or exhaust-gas after-treatment devices such as diesel particulate filters (DPF), which are equipped in internal combustion engines in conformity with recent environment-related issues.

In view of the foregoing circumstances, a first object of the present invention is to provide a lubricating oil composition with excellent long-drain properties such as oxidation stability and base number retention properties and high-temperature detergency, by optimizing an anti-wear agent to be used.

The inventor of the present invention has already found that a lubricating oil composition containing less or no zinc dialkyldithiophosphate having been used conventionally but containing a specific phosphorus-containing compound was able to exhibit extremely excellent long-drain properties (oxidation stability, base number retention properties and thermal stability) while maintaining anti-wear properties equally to a composition containing zinc dialkyldithiophosphate and filed a patent application for such a lubricating oil composition, as disclosed in Japanese Patent Laid-Open Publication No. 2002-294271.

It was confirmed that a lubricating oil composition containing such a specific phosphorus compound was able to exhibit anti-wear properties evaluated by a valve train wear test for domestically produced automobile engines as represented by JASO M328-95 comparably to a composition containing zinc dithiophosphate, due to the optimized blend with other additives. However, a lubricating oil is required to possess extreme pressure properties and anti-wear properties more excellent than ever so as to be used in a special engine operating under more severe conditions or used under particular circumstances where more excellent extreme pressure properties and anti-wear properties are required; or required to fulfill a requirement that the phosphorus content is decreased to 0.08 percent by mass or less to meet the suitableness for an exhaust-gas purifying catalyst in the forthcoming ILSAC GF-4 standard or another requirement of low phosphorus content that the phosphorus content is decreased to 0.05 percent by mass or less to be sought in ILSAC GF-5 standard which is a plan under consideration. However, it is difficult to decrease the phosphorus content of a lubricating oil with a sulfur-free phosphorus compound because extreme pressure properties and anti-wear properties are deteriorated when the phosphorus content is simply decreased. Alternatively, the use of a sulfur-containing compound increases the sulfur content of a lubricating oil which thus exerts harmful influence on an exhaust-gas after-treatment device, i.e., fails to dissolve the problems that an exhaust-gas purifying catalyst such as a ternary catalyst, an oxidation catalyst and a NOx adsorber and DPF or an exhaust-gas treatment system which is the combination of DPF with the exhaust-gas purifying catalyst, particularly the oxidation catalyst or NOx adsorber undergo to catalyst poisoning and/or clogging of DPF caused by the increased sulfur. Furthermore, the lubricating oil will be extremely deteriorated in oxidation stability, base number retention properties and detergency.

Therefore, it has been very difficult to produce a lubricating oil which can achieve the decrease of phosphorus and sulfur or additionally ash content with maintaining both excellent long-drain properties and anti-wear properties. Such a lubricating oil has been demanded.

In view of the foregoing circumstances, a second object of the present invention is to provide a lubricating oil composition which is further improved in anti-wear properties with maintaining long-drain properties in a higher level, particularly suitable for a low phosphorus and sulfur type internal combustion engine.

BRIEF SUMMARY OF THE INVENTION

As a result of an extensive study and research conducted to achieve the first and second objects, the present invention was completed based on the findings that a lubricating oil composition containing a specific phosphorus-containing additive was able to achieve the first object and that the use of a specific phosphorus compound in combination with a metal salt of a specific phosphorus compound in a lubricating oil was able to improve the anti-wear properties synergistically, decrease the phosphorus and sulfur contents, and provide the oil with extremely excellent long-drain properties.

That is, a first aspect of the present invention is to provide a lubricating oil composition comprising a lubricating base oil and (A) at least one type of compound selected from the group consisting of phosphorus compounds represented by formula (1) below and salts thereof:

(1)

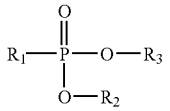

wherein $R_1$ is a hydrocarbon group which may contain nitrogen and/or oxygen, and $R_2$ and $R_3$ are each independently hydrogen or a hydrocarbon group having 1 to 30 carbon atoms, which may contain nitrogen and/or oxygen.

A second aspect of the present invention is to provide a lubricating oil composition comprising a lubricating base oil, (A) at least one type of compound selected from the group consisting of phosphorus compounds represented by formula (1) below and salts thereof, and (B) at least one type of compound selected from the group consisting of metal salts of phosphorus compounds represented by formulas (2) and (3) below:

(1)

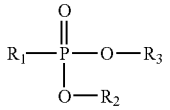

wherein $R_1$ is a hydrocarbon group which may contain nitrogen and/or oxygen, and $R_2$ and $R_3$ are each independently hydrogen or a hydrocarbon group having 1 to 30 carbon atoms, which may contain nitrogen and/or oxygen;

(2)

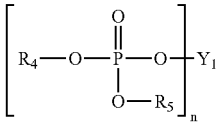

wherein $R_4$ and $R_5$ are each independently a hydrocarbon group having 3 to 30 carbon atoms, which may contain nitrogen and/or oxygen, $Y_1$ is a metal element, and n is an integer corresponding to the valence of $Y_1$; and (3)

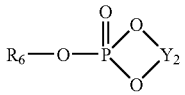

wherein $R_6$ is a hydrocarbon group having 3 to 30 carbon atoms, which may contain nitrogen and/or oxygen, and $Y_2$ is a metal element.

The present invention also provides a low sulfur and phosphorus long-drain engine system wherein an internal combustion engine using a fuel whose sulfur content is 50 ppm by mass or less is lubricated with a lubricating oil composition comprising a lubricating base oil, Component (A) or in addition thereto Component (B) and containing sulfur in an amount of 0.3 percent by mass or less and phosphorus in an amount of 0.08 percent by mass or less based on the total mass of the composition.

DETAILED DESCRIPTION OF THE INVENTION

The present invention will be described in more detail below.

No particular limitation is imposed on lubricating base oils used in the present invention. Therefore, any conventional mineral and/or synthetic base oils used for lubricating oils may be used.

Specific examples of mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax) produced through a Fischer-Tropsch process.

Although no particular limitation is imposed on the total aromatic content of the mineral base oils, it is preferably 10 percent by mass or less, more preferably 6 percent by mass or less, further more preferably 3 percent by mass or less, and particularly preferably 2 percent by mass or less. A lubricating oil composition with more excellent oxidation stability can be obtained by decreasing the total aromatic content of a base oil to 10 percent by mass or less.

The term "total aromatic content" used herein denotes an aromatic fraction content determined in accordance with ASTM D2549. The aromatic fraction includes alkylbenzenes; alkylnaphthalens; anthracene, phenanthrene, and alkylated products thereof; compounds wherein four or more benzene rings are condensated to each other; and compounds having heteroaromatics, such as pyridines, quinolines, phenols, and naphthols.

Although no particular limitation is imposed on the % $C_A$ of the mineral base oils, it is preferably 5 or less, more preferably 3 or less, and further more preferably 2 or less. The % $C_A$ may be 0 but is preferably 0.4 or greater and more preferably 1 or greater with the objective of solubility of additives.

The term "% $C_A$" denotes a percentage of the carbon number of the aromatics to the total carbon number as measured by a method defined by ASTM D 3238-85.

Although not restricted, the sulfur content of the mineral base oils is preferably 0.05 percent by mass or less, more preferably 0.01 percent by mass or less, and particularly preferably 0.001 percent by mass or less. A low sulfur lubricating oil composition with more excellent long-drain properties can be obtained by decreasing the sulfur content of a mineral base oil.

Specific examples of synthetic base oils include polybutenes and hydrides thereof; poly-α-olefins such as 1-octene oligomer and 1-decene oligomer, and hydrides thereof; diesters such as ditridecyl glutarate, di-2-ethylhexyl adipate, diisodecyl adipate, ditridecyl adipate, and di-2-ethylhexyl cebacate; polyolesters such as trimethylolpropane caprylate, trimethylolpropane pelargonate, pentaerythritol-2-ethyl hexanoate, and pentaerythritol pelargonate; copolymers of dicarboxylic acids such as dibutyl maleate and α-olefins having 2 to 30 carbon atoms; aromatic synthetic oils such as alkylnaphthalenes, alkylbenzenes, and aromatic esters; and mixtures thereof.

Any one of the above-described mineral base oils or synthetic base oils or any mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

Although no particular limitation is imposed on the kinematic viscosity at 100° C. of the lubricating base oil used in the present invention, it is preferably 20 $mm^2/s$ or lower, more preferably 10 $mm^2/s$ or lower, and preferably 1 $mm^2/s$ or higher, more preferably 2 $mm^2/s$ or higher. A lubricating base oil with a kinematic viscosity at 100° C. exceeding 20 $mm^2/s$ is not preferred because the low temperature viscosity characteristics of the resulting lubricating oil composition would be deteriorated, while that with a kinematic viscosity at 100° C. of less than 1 $mm^2/s$ is not also preferred because the resulting lubricating oil composition would be poor in lubricity due to its insufficient oil film formation capability at lubricated sites and large in evaporation loss of the base oil.

The evaporation loss of the base oil used in the present invention is preferably 20 percent by mass or less, more preferably 16 percent by mass or less, and particularly preferably 10 percent by mass or less, as measured by NOACK evaporation analysis. A lubricating base oil with a NOACK evaporation loss exceeding 20 percent by mass is not preferred because the resulting lubricating oil composition would be large in evaporation loss of the base oil and the sulfur and phosphorus compounds or metals in the composition would accumulate on an exhaust gas purifying device together with the base oil, resulting not only in the increase of oil consumption but also in adverse affect on the exhaust gas purifying performance. The term "NOACK evaporation" used herein is defined as the amount of a sample lubricating oil of 60 g, which is lost when the oil is retained at a temperature of 250° C. and a pressure of 20 $mmH_2O$ (196 Pa) for one hour in accordance with ASTM D 5800.

Although no particular limitation is imposed on the viscosity index of the lubricating base oil used, it is preferably 80 or higher, more preferably 100 or higher, and further more preferably 120 or higher so as to be able to obtain excellent viscosity characteristics ranging from low temperatures to high temperatures. No particular limitation is imposed on the upper limit of the viscosity index. Therefore, the lubricating base oil may be those with a viscosity index of on the order of 135 to 180, such as n-paraffins, slack waxes and GTL waxes or isoparaffin-based mineral oils obtained by isomerization thereof and those with a viscosity index of on order of 150 to 250, such as complex ester-based or HVI-PAO-based base oils. A lubricating base oil with a viscosity index of less than 80 is not preferred because the low-temperature viscosity characteristics would be deteriorated.

Component (A) of the lubricating oil composition is at least one type of compound selected from the group consisting of phosphorus compounds represented by formula (1) and salts thereof:

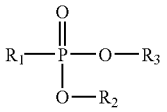

(1)

In formula (1), $R_1$ is a hydrocarbon group having one or more carbon atoms and preferably a hydrocarbon group having 1 to 30 carbon atoms, and $R_2$ and $R_3$ are each independently hydrogen or a hydrocarbon group having 1 to 30 carbon atoms. These hydrocarbon groups may contain nitrogen and/or oxygen.

Specific examples of the hydrocarbon groups include alkyl, cycloalkyl, alkenyl, alkyl-substituted cycloalkyl, aryl, alkyl-substituted aryl, and arylalkyl groups. More specific examples include straight-chain or branched alkyl groups, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl groups; cycloalkyl groups having 5 to 7 carbon atoms, such as cyclopentyl, cyclohexyl, and cycloheptyl groups; alkylcycloalkyl groups having 6 to 10 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, and methylethylcycloheptyl groups, of which the alkyl groups may bond to any position of the cycloalkyl groups; straight-chain or branched alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl and nonadecenyl groups, the position of which the double bonds may vary; aryl groups such as phenyl and naphtyl groups; alkylaryl groups having 7 to 10 carbon atoms, such as tolyl, xylyl, ethylphenyl, propylphenyl, and butylphenyl groups, of which the alkyl groups may be straight-chain or branched and may bond to any position of the aryl groups; and arylalkyl groups having 7 to 10 carbon atoms, such as benzyl, phenylethyl, phenylpropyl, and phenylbutyl groups, of which the alkyl groups may be straight-chain or branched.

The hydrocarbon groups having 1 to 30 carbon atoms are preferably hydrocarbon groups having 2 to 24 carbon atoms, more preferably those having 3 to 20 carbon atoms. More specifically, the hydrocarbon groups are preferably alkyl groups having 1 to 30 carbon atoms or aryl groups having 6 to 24 carbon atoms, more preferably alkyl groups having 3 to 18 carbon atoms, and most preferably alkyl groups having 4 to 12 carbon atoms.

Examples of phosphorus compounds represented by formula (1) include phosphonic acids wherein $R_1$ is a hydrocarbon group having one or more carbon atoms, and both $R_2$ and $R_3$ are hydrogen; phosphonic acid monoesters wherein $R_1$ is a hydrocarbon group having one or more carbon atoms, and either one of $R_2$ or $R_3$ is a hydrocarbon group having 1 to 30 carbon atoms and the other is hydrogen; phosphonic acid diesters wherein $R_1$ is a hydrocarbon group having one or more carbon atoms, and both $R_2$ and $R_3$ are hydrocarbon groups having 1 to 30 carbon atoms; and mixtures thereof.

Specific examples of these phosphorus compounds include alkyl or alkenyl phosphonic acids such as mono(n-butyl) phosphonic acid, mono(isobutyl) phosphonic acid, mono(n-pentyl) phosphonic acid, mono(n-hexyl) phosphonic acid, mono(1,3-dimethylbutyl) phosphonic acid, mono(4-methyl-2-pentyl) phosphonic acid, mono(n-heptyl) phosphonic acid, mono(n-octyl) phosphonic acid, mono(2-ethylhexyl) phosphonic acid, mono(isodecyl) phosphonic acid, mono(n-dodecyl) phosphonic acid, mono(diisotridecyl) phosphonic acid, mono(oleyl) phosphonic acid, mono(stearyl) phosphonic acid, and mono(n-octadecyl) phosphonic acid; alkyl or alkenyl phosphonic acid monoesters such as n-butyl phosphonic acid mono(n-butyl) ester, isobutyl phosphonic acid mono (isobutyl) ester, n-pentyl phosphonic acid mono(n-pentyl) ester, n-hexyl phosphonic acid mono(n-hexyl) ester, 1,3-dimethylbutyl phosphonic acid mono(1,3-dimethylbutyl) ester, 4-methyl-2-pentyl phosphonic acid mono(4-methyl-2-pentyl) ester, n-heptyl phosphonic acid mono(n-heptyl) ester, n-octyl phosphonic acid mono(n-octyl) ester, 2-ethylhexyl phosphonic acid mono(2-ethylhexyl) ester, isodecyl phosphonic acid mono(isodecyl) ester, n-dodecylphosphonic acid mono(n-dodecyl) ester, isotridecyl phosphonic acid mono (isotridecyl) ester, oleyl phosphonic acid mono(oleyl) ester, stearyl phosphonic acid mono(stearyl) ester, octadecyl phosphonic acid mono(octadecyl) ester, butyl phosphoric acid mono(octyl) ester, butyl phosphonic acid mono(oleyl) ester, 2-ethylhexyl phosphonic acid mono(butyl) ester, 2-ethylhexyl phosphonic acid mono(oleyl) ester, oleyl phosphonic acid mono(methyl) ester, oleyl phosphonic acid mono(butyl) ester, oleyl phosphonic acid mono(octyl) ester, oleyl phosphonic acid mono(dodecyl) ester, octadecyl phosphonic acid mono(methyl) ester, and octadecyl phosphonic acid mono (ethyl) ester; alkyl or alkenyl phosphonic acid diesters such as n-butyl phosphonic acid di(n-butyl) ester, isobutyl phosphonic acid di(isobutyl) ester, n-pentyl phosphonic acid di(n-pentyl) ester, n-hexyl phosphonic acid di(n-hexyl) ester, 1,3-dimethylbutyl phosphonic acid di(1,3-dimethylbutyl) ester, 4-methyl-2-pentyl phosphonic acid di(4-methyl-2-pentyl) ester, n-heptyl phosphonic acid di(n-heptyl) ester, n-octyl phosphonic acid di(n-octyl) ester, 2-ethylhexyl phosphonic acid di(2-ethylhexyl) ester, isodecyl phosphonic acid di(isodecyl) ester, n-dodecyl phosphonic acid di(n-dodecyl) ester, isotridecyl phosphonic acid di(isotridecyl) ester, oleylphosphonicacid di(oleyl) ester, stearyl phosphonic acid di(stearyl) ester, octadecyl phosphonic acid di(octadecyl) ester, octadecyl phosphonic acid di(methyl) ester, octadecyl phosphonic acid di(ethyl) ester, octadecyl phosphonic acid di(propyl) ester, oleyl phosphonic acid di(methyl) ester, and stearyl phosphonic acid di(methyl) ester; and mixtures thereof.

A phosphorus compounds represented by formula (1) is preferably at least one type of compound (phosphonic acid diester) selected from the group consisting of phosphorus compounds wherein all $R_1$, $R_2$, and $R_3$ are hydrocarbon groups having 1 to 30 carbon atoms with the objective of excellent base number retention properties and high-temperature detergency. Among these compounds, preferred are phosphonic acid diesters wherein all $R_1$, $R_2$, and $R_3$ are hydrocarbon groups having 4 to 9 carbon atoms, such as 2-ethylhexyl phosphonic acid di(2-ethylhexyl) ester.

Examples of salts of compounds represented by formula (1) include those obtained by allowing a metal base such as a metal oxide, a metal hydroxide, a metal carbonate and a metal chloride or a nitrogen-containing compound such as ammonia and an amine compound having in its molecules only a hydrocarbon group having 1 to 30 carbon atoms or a hydroxyl group-containing hydrocarbon group having 1 to 30 carbon atoms to react with a phosphorus compound wherein $R_1$ is a hydrocarbon group having one or more carbon atoms, and at least either one of $R_2$ or $R_3$ is hydrogen, so as to neutralize part or whole of the remaining acid hydrogen.

Specific examples of the metals of the above-mentioned metal bases include alkali metals such as lithium, sodium, potassium, and cesium, alkaline earth metals such as calcium, magnesium, and barium, and heavy metals such as zinc, copper, iron, lead, nickel, silver, manganese, and molybdenum. Among these metals, preferred are alkaline earth metals such as calcium and magnesium, and zinc, and particularly preferred is zinc.

The above-described metal salts of the phosphorus compounds vary in structure depending on the valence of metals and the number of OH group of the phosphorus compounds. Therefore, no particular limitation is imposed on the structure of the metal salts of the phosphorus compounds. For example, when 1 mol of zinc oxide is reacted with 2 mol of a phosphonic acid monoester (with one OH group), it is assumed that a compound with a structure represented by the formula below is obtained as the main component but polymerized molecules may also exist:

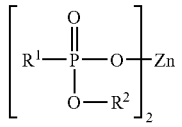

For another example, when 1 mol of zinc oxide is reacted with 1 mol of phosphoric acid (with two OH groups), it is assumed that a compound with a structure represented by the formula below is obtained as the main component but polymerized molecules may also exist:

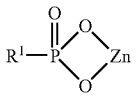

Specific examples of the nitrogen-containing compound include ammonia, monoamines, diamines, and polyamines. More specific examples include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight-chain or branched alkenyl group having 2 to 30 carbon atoms, such as ethenylamine, propenylamine, butenylamine, octenylamine, and oleylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, specifically undecyldiethylamine, undecyldiethanolamine, dodecyldipropanolamine, oleyldiethanolamine, oleylpropylenediamine, and stearyltetraethylenepentamine and N-hydroxyethyloleylimidazoline; alkyleneoxide adducts thereof; and mixtures thereof.

Among these nitrogen-containing compounds, preferred examples include aliphatic amines having an alkyl or alkenyl group having 10 to 20 carbon atoms, which may be straight-chain or branched, such as decylamine, dodecylamine, tridecylamine, heptadecylamine, octadecylamine, oleylamine, and stearylamine.

A metal salt of a phosphorus compound represented by formula (1) is preferably at least one type of compound selected from the group consisting of metal salts of phosphorus compounds where $R_1$ is a hydrocarbon group having 1 to 30 carbon atoms, and either one of $R_2$ or $R_3$ is hydrogen. Among these compounds, more preferred are zinc salts of phosphorus compounds wherein $R_1$ is a hydrocarbon group having 4 to 9 carbon atoms, and either one of $R_2$ or $R_3$, preferably both of $R_2$ and $R_3$ are hydrogen with the objective of excellent base number retention properties and high-temperature detergency.

An amine salt of a phosphorus compound represented by formula (1) is preferably at least one type of compound selected from the group consisting of amine salts of phosphorus compounds wherein $R_1$ is a hydrocarbon group having 1 to 30 carbon atoms, and either one of $R_2$ or $R_3$ is hydrogen. Among these compounds, more preferred are amine salts of phosphorus compounds wherein $R_1$ is a hydrocarbon group having 4 to 9 carbon atoms, and either one of $R_2$ or $R_3$, preferably both of $R_2$ and $R_3$ are hydrogen with the objective of excellent base number retention properties and high-temperature detergency.

One or more types of Components (A) may be arbitrarily blended.

In the present invention, Component (A) is preferably a phosphonic acid diester where $R_1$ is a hydrocarbon group having one or more carbon atoms, and $R_2$ and $R_3$ are each independently a hydrocarbon group having 1 to 30 carbon atoms and more preferably $R_1$ is a hydrocarbon group having 10 to 30 and preferably 12 to 18 carbon atoms, and $R_2$ and $R_3$ are each independently a hydrocarbon group having 1 to 9, preferably 1 to 4 carbon atoms, and particularly preferably methyl because Component (A) can synergistically improve anti-wear properties and can further decrease the phosphorus and ash contents of the resulting lubricating oil composition when used in combination with Component (B).

Although no particular limitation is imposed on the content of Component (A), the lower limit is generally 0.001 percent by mass, preferably 0.01 percent by mass, and more preferably 0.02 percent by mass in terms of phosphorus based on the total mass of the composition. No particular limitation is imposed on the upper limit content of Component (A), either and thus a lubricating oil additive composition containing Component (A) in a higher concentration may be provided. However, the upper limit is generally 1 percent by mass, preferably 0.2 percent by mass, more preferably 0.1 percent by mass, further more preferably 0.08 percent by mass, and particularly preferably 0.05 percent by mass in terms of phosphorus based on the total mass of the composition. Component (A) of the lower limit or more can provide a lubricating oil composition with excellent extreme pressure properties and anti-wear properties, while Component (A) of the upper limit or lower can achieve the decreased phosphorus content of a lubricating oil. Particularly, when the lubricating oil composition is used as that for an internal combustion engine, Component (A) of 0.08 percent by mass or less, particularly 0.05 percent by mass or less results in a low phophorus type lubricating oil composition which is extremely less in adverse affects on an exhaust gas purifying devices.

The lubricating oil composition of the present invention can be improved in oxidation stability with maintaining anti-wear properties by blending Component (A) even though a sulfur-containing compound such as zinc dithiophosphate is decreased or not used at all.

In addition to Component (A), the lubricating oil composition of the present invention containing Component (B) described below is extremely excellent in oxidation stability, base number retention properties and high-temperature detergency and is synergistically improved in anti-wear properties.

Component (B) is at least one type of compound selected from the group consisting of metal salts of phosphorus compounds represented by formulas (2) and (3) below:

(2)

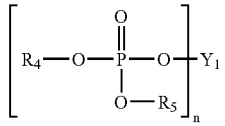

(3)

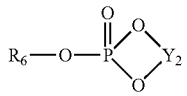

In formula (2), $R_4$ and $R_5$ are each independently a hydrocarbon group having 3 to 30 carbon atoms, which may contain nitrogen and/or oxygen, $Y_1$ is a metal element, and n is an integer corresponding the valence of $Y_1$; and In formula (3), $R_6$ is a hydrocarbon group having 3 to 30 carbon atoms, which may contain nitrogen and/or oxygen, and $Y_2$ is a divalent metal element.

Specific Examples of the hydrocarbon group having 3 to 30 carbon atoms include alkyl, cycloalkyl, alkenyl, alkyl-substituted cycloalkyl, aryl, alkyl-substituted aryl, and arylalkyl groups, which may contain oxygen and/or nitrogen.

Examples of the alkyl groups include straight-chain or branched alkyl groups, such as propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl groups include those having 5 to 7 carbon atoms, such as cyclopentyl, cyclohexyl, and cycloheptyl groups. Examples of the alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups.

Examples of the alkenyl groups include straight-chain or branched alkenyl groups such as propenyl, butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, and octadecenyl groups, the position of which the double bonds may vary.

Examples of the aryl groups include those such as phenyl and naphtyl groups. Examples of the alkylaryl groups include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphneyl groups, of which the alkyl groups may be straight-chain or branched and may bond to any position of the aryl groups.

Examples of the arylalkyl groups include those having 7 to 12 carbon atoms, such as benzyl, phenylethyl, phenylpropyl, and phenylbutyl, phenylpentyl, and phenylhexyl groups, of which the alkyl groups may be straight-chain or branched.

The hydrocarbon groups having 3 to 30 carbon atoms are preferably alkyl or alkenyl groups having 3 to 18 carbon atoms, more preferably alkyl or alkenyl groups having 4 to 12 carbon atoms, further more preferably alkyl groups having 4 to 8 carbon atoms, and particularly preferably alkyl groups having 4 to 6 carbon atoms.

Examples of Components (B) include salts obtained by allowing a metal base such as a metal oxide, a metal hydroxide, a metal carbonate and a metal chloride to react with a phosphoric acid ester having one or more hydrocarbon groups having 3 to 30 carbon atoms, which may contain nitrogen and/or oxygen, so as to neutralize part or whole of the remaining acid hydrogen.

Examples of the phosphoric acid ester include phosphoric acid diesters and monoesters having the above-exemplified hydrocarbon group having 3 to 30 carbon atoms, which may contain oxygen and/or nitrogen, or compounds of formulas (2) and (3) wherein —$(OR_7)_n$— ($R_7$ is an alkylene group having 1 to 4, and n is an integer of 1 to 10) is inserted between the oxygen added to the hydrocarbon group having 3 to 30 carbon atoms, which may contain oxygen and/or nitrogen, and the phosphorus.

Preferred specific examples of Component (B) include metal salts of phosphoric acid mono or di(n-butyl) ester, phosphoric acid mono or di(isobutyl) ester, phosphoric acid mono or di(n-pentyl) ester, phosphoric acid mono or di(n-hexyl) ester, phosphoric acid mono or di(1,3-dimethylbutyl) ester, phosphoric acid mono or di(4-methyl-2-pentyl) ester, phosphoric acid mono or di(n-heptyl) ester, phosphoric acid mono or di(n-octyl) ester, phosphoric acid mono or di(2-ethylhexyl) ester, phosphoric acid mono or di(isodecyl) ester, phosphoric acid mono or di(n-dodecyl) ester, phosphoric acid mono or di(isotridecyl) ester, phosphoric acid mono or di(oleyl) ester, phosphoric acid mono or di(stearyl) ester, and phosphoric acid mono or di(n-octadecyl) ester and those containing different hydrocarbon groups in the molecule, such as metal salts of phosphoric acid butyl ester 2-ethylhexyl ester and phosphoric acid butyl ester oleyl ester. Examples of metals of the above-mentioned metal salts include alkali metals such as lithium, sodium, potassium, and cesium, alkaline earth metals such as calcium, magnesium, and barium, heavy metals such as aluminum, zinc, copper, iron, lead, nickel, silver, manganese, and molybdenum, and mixtures thereof. Among these metals, preferred are alkali metals, alkaline earth metals, zinc, copper, aluminum, and molybdenum, more preferred are alkaline earth metals and zinc, and most preferred is zinc.

Since some compounds selected from Components (B) are insoluble or less soluble in a lubricating oil, it is particularly preferred with the objective of solubility of Component (B) and shortened production time of the lubricating oil composition that the compounds be presented as an oil-solved additive before it is blended to a lubricating base oil. No particular limitation is imposed on the method of rendering Component (B) oil soluble. Therefore, there may be employed a method wherein Component (B) is mixed with and dissolved in or reacted with an amine compound, including an ashless dispersant such as succinimide and/or a derivative thereof, an aliphatic amine, an aromatic amine and a polyamine, or a mixture thereof in an organic solvent such as hexane, toluene, or decalin at a temperature of 15 to 150° C., preferably 30 to 120° C., and particularly preferably 40 to 90° C. for a period of 10 minutes to 5 hours, preferably 20 minutes to 3 hours, and particularly preferably 30 minutes to one hour and then subjected to vacuum-distillation to remove the solvent; methods similar thereto; or other known methods. The same is applied to Component (A).

No particular limitation is imposed on the content of Component (B) in the lubricating oil composition of the present invention. However, the lower limit content is generally 0.001 percent by mass, preferably 0.01 percent by mass, and more preferably 0.02 percent by mass in terms of phosphorus based on the total mass of the composition. The upper limit is not limited, either. Therefore, the lubricating oil additive composition containing Component (B) in a higher concentration may be provided. However, the upper limit is generally 0.2 percent by mass, preferably 0.1 percent by mass, more preferably 0.08 percent by mass, and particularly preferably 0.05 percent by mass in terms of phosphorus based on the total mass of the composition. Component (B) of the lower limit or more can provide the resulting lubricating oil composition with excellent extreme pressure properties and anti-wear properties, while Component (B) of the upper limit or less can achieve the decrease of phosphorus content of the lubricating oil composition. Particularly when the lubricating oil composition of the present invention is used for an internal combustion engine, Component (B) of 0.08 percent by mass or less, particularly 0.05 percent by mass or less is contributive to the production of a low phosphorus type lubricating oil composition which is extremely less in adverse affects on the exhaust-gas purifying device.

No particular limitation is imposed on the content ratio of Components (A) and (B). The ratio is preferably from 10:90 to 90:10, more preferably 20:80 to 80:20, further more preferably 30:70 to 70:30, and particularly preferably 40:60 to 60:40 by mass in terms of phosphorus contained in each component. The anti-wear properties of the lubricating oil composition of the present invention can be synergistically improved by the content ratio of Components (A) and (B) in the above range.

No particular limitation is imposed on the total content of Components (A) and (B). However, the lower limit content is generally 0.001 percent by mass, preferably 0.01 percent by mass, and further more preferably 0.02 percent by mass in terms of phosphorus based on the total mass of the composition. The upper limit is not limited, either. Therefore, the lubricating oil additive composition containing Components (A) and (B) at a higher concentration may be provided. However, the upper limit is generally 0.2 percent by mass, preferably 0.1 percent by mass, more preferably 0.08 percent by mass, and particularly preferably 0.05 percent by mass in terms of phosphorus based on the total mass of the composition. Components (A) and (B) of the lower limit or more can provide the resulting lubricating oil composition with excellent extreme pressure properties and anti-wear properties. Furthermore, Components (A) and (B) of the upper limit or less can decrease the phosphorus content of the resulting lubricating oil composition. Particularly when a lubricating oil composition containing Components (A) and (B) of the upper limit or less is used as an internal combustion engine, it is possible to achieve the further decrease of the phosphorus content thereof due to expected synergistic effects of Components (A) and (B) and provide a low phosphorus type lubricating oil composition which is extremely less in adverse affect on the exhaust gas purifying device with 0.08 percent by mass, particularly 0.05 percent by mass of Components (A) and (B).

The lubricating oil composition of the present invention preferably contains (C) a chain reaction terminator (free radical inhibitor). The chain reaction terminator (free radical inhibitor) is generally distinguished from peroxide decomposers including sulfur-containing organic metal compounds or organic sulfur compounds such as zinc dithiophosphate, molybdenum dithiocarbamate, olefin sulfides and sulfides and acts to terminate the chain oxidation deterioration of a lubricating oil, and more specifically supplements and stabilizes radicals generated during the oxidation deterioration of a lubricating oil and becomes a stabilized radical by itself or further supplements and stabilizes radicals.

Examples of (C) a chain reaction terminator (free radical inhibitor) include phenol-based anti-oxidants and amine-based anti-oxidants. However, any compounds may be used as long as they have the same functional mechanism.

Examples of the phenol-based anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'-dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl) propionate, pentaerythrityl-tetraquis[3-(3,5-di-tert-butyl-4-hydroxyphenyl)propionate], octyl-3-(3,5-di-tert-butyl-4-hydroxyphenyl) propionate, octadecyl-3-(3,5-di-tert-butyl-4-hydroxyphenyl) propionate and octyl-3-(3-methyl-5-tert-butyl-4-hydroxyphenyl) propionate. Mixtures of two or more of these compounds may be used.

Examples of the amine-based anti-oxidants include phenyl-α-naphtylamines, alkylphenyl-α-naphtylamines, dialkyldiphenylamines, and phenothiazine. A mixture of two or more of these anti-oxidants may be blended.

Particularly preferred chain reaction terminator (free radical inhibitor) are anti-oxidants composed of the above-described phenol-based anti-oxidants and/or amine-based anti-oxidants.

The content of Component (C) in the lubricating oil composition is preferably 5.0 percent by mass or less, more preferably 3.0 percent by mass or less, and further more preferably 2.5 percent by mass or less based on the total mass of the composition. Component (C) of more than 5.0 percent by mass fails to obtain sufficient base number retention properties as balanced with the content. The content of Component (C) is 0.1 percent by mass or more and more preferably 1 percent by mass or more based on the total mass of the composition with the objective of further enhancement of the base number retention properties.

The lubricating oil composition of the present invention preferably contains (D) an ashless dispersant and/or (E) a metallic detergent.

Component (D), i.e., ashless dispersant may be any of those used in lubricating oils, such as nitrogen-containing compounds having at least one straight-chain or branched alkyl or alkenyl group having 40 to 400 carbon atoms in the molecules and derivatives thereof, and modified products of alkenyl succinimides. A mixture of any one or more of these compounds may be blended.

The carbon number of the alkyl or alkenyl group is preferably 40 to 400 and preferably 60 to 350. An alkyl or alkenyl group having fewer than 40 carbon atoms would deteriorate the solubility of the compound in a lubricating base oil, while an alkyl or alkenyl group having more than 400 carbon atoms would deteriorate the low-temperature fluidity of the resulting lubricating oil composition. The alkyl or alkenyl group may be straight-chain or branched but is preferably a branched alkyl or alkenyl group derived from an oligomer of an olefin such as propylene, 1-butene, and isobutylene or from a cooligomer of ethylene and propylene.

Specific examples of Component (D) include the following compounds one or more of which may be used:

(D-1) succinimides having in their molecules at least one alkyl or alkenyl group having 40 to 400 carbon atoms and derivatives thereof;

(D-2) benzylamines having in their molecules at least one alkyl or alkenyl group having 40 to 400 carbon atoms and derivatives thereof; and (D-3) polyamines having in their molecules at least one alkyl or alkenyl group having 40 to 400 carbon atoms and derivatives thereof.

Specific examples of (D-1) succinimides include compounds represented by formulas (4) and (5):

(4)

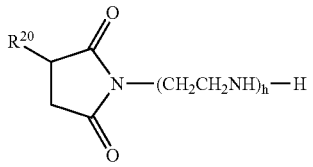

wherein $R^{20}$ is an alkyl or alkenyl group having 40 to 400 and preferably 60 to 350 carbon atoms, and h is an integer from 1 to 5, preferably 2 to 4; and (5)

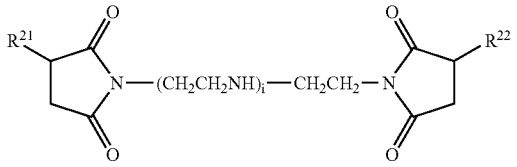

wherein $R^{21}$ and $R^{22}$ are each independently an alkyl or alkenyl group having 40 to 400, preferably 60 to 350 carbon atoms, and particularly preferably a polybutenyl group, and i is an integer from 0 to 4, preferably 1 to 3.

Succinimides include mono-type succinimides wherein a succinic anhydride is added to one end of a polyamine, as represented by formula (4) and bis-type succinimides wherein a succinic anhydride is added to both ends of a polyamine, as represented by formula (5). The lubricating oil composition may contain either type of the succinimides or mixtures thereof.

No particular limitation is imposed on the method of producing these succinimides. For example, there may be used a method wherein an alkyl or alkenyl succinimide obtained by reacting a compound having an alkyl or alkenyl group having 40 to 400 carbon atoms with maleic anhydride at a temperature of 100 to 200° C. is reacted with a polyamine such as diethylene triamine, triethylene tetramine, tetraethylene pentamine or pentaethylene hexamine.

Specific examples of (D-2) benzylamines include compounds represented by formula (6):

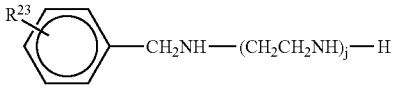

(6)

wherein $R^{23}$ is an alkyl or alkenyl group having 40 to 400 and preferably 60 to 350 carbon atoms, and j is an integer from 1 to 5, preferably 2 to 4.

Although no particular limitation is imposed on the method for producing the benzylamines, they may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (D-3) polyamines include compounds represented by formula (7):

$$R^{24}—NH—(CH_2CH_2NH)_k—H \quad (7)$$

wherein $R^{24}$ is an alkyl or alkenyl group having 40 to 400 and preferably 60 to 350, and k is an integer from 1 to 5 and preferably 2 to 4.

No particular limitation is imposed on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, and pentaethylenehexamine.

Specific examples of the derivatives of the nitrogen-containing compounds exemplified as an example of Component (D) include (i) an oxygen-containing organic compound-modified compound obtained by allowing any of the above-described nitrogen-containing compounds to react with a monocarboxylic acid having 1 to 30 carbon atoms, such as fatty acid; a polycarboxylic acid having 2 to 30 carbon atoms, such as oxalic acid, phthalic acid, trimellitic acid, and pyromellitic acid, and an anhydride or ester compound thereof; an alkyleneoxide having 2 to 6 carbon atoms; or a hydroxy(poly)oxyalkylenecarbonate so as to neutralize or amidize the part or whole of the remaining amino and/or imino groups; (ii) a boron-modified compound obtained by allowing any of the above-described nitrogen-containing compounds to react with boric acid so as to neutralize or amidize the part or whole of the remaining amino and/or imino groups; (iii) a phosphoric acid-modified compound obtained by allowing any of the above-described nitrogen-containing compounds to react with phosphoric acid so as to neutralize or amidize the part or whole of the remaining amino and/or imino groups; (iv) a sulfur-modified compound obtained by allowing any of the above-described nitrogen-containing compounds to react with a sulfuric compound; and (v) modified products obtained by a combination of two or more selected from the modifications with an oxygen-containing organic compound, boron, phosphoric acid and sulfur, of the above-described nitrogen-containing compounds. Among these derivatives, boric acid-modified compounds of alkenylsuccinimides are excellent in heat resistance and anti-oxidation properties and thus effective for further enhancing the base number retention properties of the resulting lubricating oil composition of the present invention.

When the lubricating oil composition of the present invention contains Component (D), the content thereof is from 0.01 to 20 percent by mass and preferably 0.1 to 10 percent by mass based on the total mass of the composition. Component (D) of less than 0.01 percent by mass is less effective in high temperature detergency, while Component (D) of more than 20 percent by mass deteriorates extremely the low temperature fluidity of the resulting lubricating oil composition.

Eligible metallic detergents for Component (E) are known metallic detergents which have been used for a lubricating oil composition, such as alkali metal or alkaline earth metal sulfonates, alkali metal or alkaline earth metal phenates, alkali metal or alkaline earth metal salicylates, and mixtures thereof.

Specific examples of the alkali metal or alkaline earth metal sulfonates include alkali metal or alkaline earth metal salts, preferably magnesium and/or calcium salts, of alkyl aromatic sulfonic acids, obtained by sulfonating alkyl aromatic compounds having a molecular weight of 100 to 1,500 and preferably 200 to 700. Specific examples of alkyl aromatic sulfonic acids include petroleum sulfonic acids and synthetic sulfonic acids.

Petroleum sulfonic acids may be those obtained by sulfonating alkyl aromatic compounds contained in the lubricant fraction of a mineral oil or mahogany acid by-produced upon production of white oil. The synthetic sulfonic acid may be those obtained by sulfonating an alkyl benzene having a straight-chain or branched alkyl group, produced as a by-product from a plant for producing an alkyl benzene used as the raw materials of detergents or obtained by alkylating polyolefin to benzene, or those obtained by sulfonating an dinonylnaphthalene. Although not restricted, sulfonating agents used for sulfonating these alkyl aromatic compounds may be fuming sulfuric acids and sulfuric acid.

Specific examples of the alkali metal or alkaline earth metal phenates include alkali metal or alkaline earth metal salts, preferably magnesium salts and/or calcium salts, of alkylphenols having at least one straight-chain or branched alkyl group having 4 to 30, preferably 6 to 18 carbon atoms, alkylphenolsulfides obtained by reacting such alkylphenols with sulfur, or Mannich reaction products of the alkylphenols obtained by reacting alkylphenols with formaldehyde.

Specific examples of the alkali metal or alkaline earth metal salicylates include alkali metal or alkaline earth metal salts, preferably magnesium salts and/or calcium salts, particularly preferably a calcium salts of alkyl salicylic acids having at least one straight-chain or branched alkyl group having 1 to 30, preferably 10 to 26 carbon atoms, such as those obtained by carboxylating phenol or cresol or alkylating an olefin having 10 to 26 carbon atoms.

The alkali metal or alkaline earth metal sulfonates, alkali metal or alkaline earth metal phenates, and alkali metal or alkaline earth metal salicylates include neutral salts (normal salts) obtained by reacting alkyl aromatic sulfonic acids, alkylphenols, alkylphenolsulfides, alkylsalicylic acids, or Mannich reaction products of alkylphenols directly with a metallic base such as an alkali metal or alkaline earth metal oxide or hydroxide or obtained by converting alkyl aromatic sulfonic acids, alkylphenols, alkylphenolsulfides, alkylsalicylic acids, or Mannich reaction products of alkylphenols to alkali metal salts such as sodium salts and potassium salts, followed by substitution with an alkaline earth metal salt; basic salts obtained by heating these neutral salts with an excess amount of an alkali metal or alkaline earth metal salt or an alkali metal or alkaline earth metal base (alkali metal or alkaline earth metal hydroxide or oxide) in the presence of water; and overbased salts (superbasic salts) obtained by reacting these neutral salts with a base such as an alkali metal or alkaline earth metal hydroxide in the presence of carbonic acid gas and/or boric acid or borate.

These reactions are generally carried out in a solvent (aliphatic hydrocarbon solvents such as hexane, aromatic hydrocarbon solvents such as xylene, and light lubricating base oil). Although metallic detergents are usually commercially available as diluted with a light lubricating base oil, it is preferred to use metallic detergents whose metal content is within the range of 1.0 to 20 percent by mass and preferably 2.0 to 16 percent by mass.

In the present invention, the base number of Component (E) is preferably 0 to 500 mgKOH/g and more preferably 20 to 450 mgKOH/g. Component (E) may be one or more of alkali metal or alkaline earth metal sulfonates, phenates, and salicylates. It is particularly preferred to use any of the salicylates as an essential component because of their extremely excellent long-drain properties. The term "base number" used herein denotes a base number measured by the perchloric acid potentiometric titration method in accordance with section 7 of JIS K2501 "Petroleum products and lubricants-Determination of neutralization number".

No particular limitation is imposed on the metal ratio of Component (E). Component (E) with a metal ratio of generally 20 or less and preferably from 1 to 15 is used. In the present invention, it is preferred to blend a metallic detergent with a metal ratio of 3 or less with the objective of base number retention properties. It is also preferred to use a metallic detergent with a metal ratio of greater than 3 and preferably greater than 5 with the objective of further enhancement of anti-wear properties. Therefore, desired base number retention properties and anti-wear properties are obtainable using these metallic detergents whose type and metal ratio are suitably selected, alone or in combination. The term "metal ratio" used herein is represented by "valence of metal element x metal element content (mol %)/soap group content (mol %) in a metallic detergent" wherein the metal element is calcium, magnesium, or the like and the soap group is a sulfonic acid group, a salicylic acid group, or the like.

No particular limitation is imposed on the amount of Component (E) to be blended. However, the upper limit is generally 1 percent by mass, preferably 0.5 percent by mass, and more preferably 0.2 percent by mass in terms of metal based on the total mass of the composition. The amount may be suitably selected depending the requisite sulfated ash content of the composition. The lower limit is generally 0.01 percent by mass, preferably 0.02 percent by mass, and particularly preferably 0.05 percent by mass. Component (E) of 0.01 percent by mass or more can enhance high temperature detergency and long-drain properties such as oxidation stability and base number retention properties.

In order to further enhance the performance characteristics of the lubricating oil composition of the present invention, it may be blended with any of additives which have been used in lubricating oils, depending on purposes. Examples of such additives include anti-wear agents other than Components (A) and (B), friction modifiers, viscosity index improvers, corrosion inhibitors, rust inhibitors, demulsifiers, metal passivators (metal deactivator), anti-foaming agents, and dyes.

Examples of anti-wear agents other than Components (A) and (B) include phosphorus acid esters, phosphoric acid esters, and sulfur-containing compounds such as thiophosphorus acid esters, thiophosphoric acid esters, amine salts of these esters, metal salts of thiophosphoric acid esters (zinc dithiophosphate), disulfides, olefin sulfides, sulfurized fats and oils and zinc dithiocarbamate. The anti-wear agent may be generally blended in an amount of 0.005 to 5 percent by mass. However, the lubricating oil composition of the present invention should be limited in the content of the sulfur-containing compounds, i.e., those used as these anti-wear agents. For example, the composition contains such a sulfur-containing compound in an amount of 0.1 percent by mass or less, preferably 0.05 percent by mass or less in terms of sulfur, and particularly preferably contains no zinc dithiophosphate.

Examples of friction modifiers include molybdenum dithiocarbamate, molybdenum dithiophosphate, molybdenum-amine complexes, molybdenum-succinimide complexes, molybdenum disulfide; fatty acids, aliphatic alcohols, fatty acid esters, aliphatic ethers, fatty acid amides, and aliphatic amines each having an alkyl or alkenyl group having 6 to 30 carbon atoms; and mixtures thereof. These additives are useful because they can provide the composition with low-friction properties.

Examples of viscosity index improvers include non-dispersion type viscosity index improvers such as polymers or copolymers of one or more monomers selected from various methacrylates or hydrides thereof; dispersion type viscosity index improvers such as copolymers of various methacrylates further containing nitrogen compounds; non-dispersion- or dispersion-type ethylene-α-olefin copolymers of which the α-olefin may be propylene, 1-butene, or 1-pentene, or the hydrides thereof; polyisobutylenes or the hydrides thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-α-olefin copolymers or hydrides thereof is from 800 to 500,000 and preferably from 3,000 to 200,000.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenyl succinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal passivators (metal deactivators) include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of anti-foaming agents include silicone, fluorosilicone, and fluoroalkyl ethers.

When these additives are blended with the lubricating oil composition of the present invention, the content of the viscosity index improver is selected from 0.1 to 20 percent by mass based on the total mass of the composition, the content of each of the friction modifier, corrosion inhibitor, rust inhibitor, and demulsifier is selected from 0.005 to 5 percent by mass based on the total mass of the composition, the content of the metal passivator (metal deactivator) is selected from 0.005 to 1 percent by mass based on the total mass of the composition, and the content of the anti-foaming agent is selected from 0.0005 to 1 percent by mass based on the total mass of the composition.

The lubricating oil composition of the present invention can be synergistically improved in extreme pressure properties and anti-wear properties and exhibit excellent base number retention properties, due to the use of Component (A) or in combination with Component (B). Therefore, the lubricating oil composition is useful as a low phosphorus type lubricating oil composition whose phosphorus content is 0.08 percent by mass or less, as stipulated by the forthcoming ILSAC GF-4 gasoline engine oil standard, as well as a low phosphorus and low sulfur lubricating oil composition whose phosphorus content is further decreased to 0.05 percent by mass or less and whose sulfur content is decreased to 0.3 percent by mass or less, preferably 0.2 percent by mass or less, more preferably 0.1 percent by mass or less, further more preferably 0.05 percent by mass or less, and particularly preferably 0.01 percent by mass or less.

The lubricating oil composition of the present invention is excellent not only in long drain properties (oxidation stability and base number retention properties) and anti-wear properties but also in friction reducing effect and high temperature detergency and thus is preferably used as a lubricating oil for internal combustion engines such as gasoline engines, diesel engines and gas engines of motorcycles, automobiles, power generators, and ships. Furthermore, the lubricating oil composition of the present invention is a low sulfur and phosphorus lubricating oil which is, therefore, suitable for an internal combustion engine equipped with an exhaust-gas after-treatment device such as an exhaust-gas purifying catalyst selected from a ternary catalyst, a NOx adsorber, and an oxidation catalyst and/or a diesel particulate filter (DPF), particularly an internal combustion engine equipped with an exhaust-gas after-treatment device which is the combination of an oxidation catalyst or a NOx adsorber with DPF. The lubricating oil composition of the present invention is particularly preferably used as a lubricating oil for an internal combustion engine, particularly a gasoline or gas engine, using a low sulfur fuel whose sulfur content is 50 ppm by mass or less, preferably 30 ppm by mass or less, and particularly preferably 10 ppm by mass or less, such as gasoline, gas oil, or kerosene; a fuel whose sulfur content is 1 ppm by mass, such as LPG and natural gas; or a substantially sulfur-free fuel such as hydrogen, dimethylether, alcohols, and GTL (Gas to Liquid) fuel.

Moreover, the lubricating oil composition of the present invention is suitably used as a lubricating oil required to possess any of the above-described extreme pressure properties, anti-wear properties, base number retention properties, and oxidation stability, such as those for driving systems of automatic or manual transmissions, gear oils, greases, wet brake oils, hydraulic oils, turbine oils, compressor oils, bearing oils, refrigerating oils, or the like.

The low sulfur and phosphorus engine system of the present invention uses a lubricating oil composition comprising a base oil, Component (A) or in addition thereto Component (B) and containing 0.3 percent by mass or less of sulfur and 0.08 percent by mass or less of phosphorus, and uses a fuel containing 50 ppm by mass or less of sulfur thereby improving long-drain properties and anti-wear properties and reducing adverse affects on an exhaust-gas after-treatment device such as a oxidation catalyst, a ternary catalyst, a NOx adsorber, and DPF.

BEST MODES FOR CARRYING OUT THE INVENTION

Hereinafter, the present invention will be described in more details by way of the following examples and comparative examples, which should not be construed as limiting the scope of the invention.

EXAMPLES 1 TO 3, AND COMPARATIVE EXAMPLE 1

Lubricating oil compositions of the present invention (Examples 1 to 3) and that for comparison (Comparative Example 1) were prepared as set forth in Table 1 below.

The following performance evaluation tests were conducted for each of the resulting compositions. The results are shown in Table 1.

(1) High Temperature Detergency Evaluated by a Hot Tube Test

The hot tube test was conducted in accordance with JPI-5S-5599. Each of the compositions was rated from 10 to 0. A rating of 10 indicates colorless and transparent (no deposit) and a rating of 0 point indicates black and opaque. Between 10 and 0, evaluation was done using reference tubes which were made per grade beforehand.

At 290° C., a rating of 6 or greater indicates that the composition is considered as a lubricating oil with excellent detergency for an ordinary gasoline or diesel engine. However, it is preferred that a lubricating oil for a gas engine exhibit an excellent detergency at 300° C. or higher as well in this test.

(2) Changes in Base Number with Time by ISOT

Each of the compositions was forced to deteriorate at a temperature of 165.5° C. and measured for change in base number remaining rate (hydrochloric acid method) with time in accordance with "Lubricating Oils for Internal Combustion Engine-Determination of Oxidation Stability Test" (Indiana Stirring Oxidation Test (ISOT), JIS K 2514). A higher base number remaining rate against the testing time indicates that the composition is enhanced in base number retention properties and thus is a long drain oil which is able to be used for a long period of time.

(3) Changes in Base Number with Time Measured by a NOx Adsorbing Test

Each of the sample oils was forced to deteriorate by blowing thereto a NOx gas under the conditions (150° C., NOx: 1198 ppm) in compliance with those described in "Japanese Society of Tribologists Conference Preliminary Reports 1992, 10, 465" and measured for change in base number (hydrochloric acid method) with time. A higher base number remaining rate against the testing time indicates that the composition is enhanced in base number retention properties even in the presence of NOx as used in an internal combustion engine and is a long drain oil which can be used for a long period time.

(4) High-Speed Four-Ball Test

Each of the test oils was subjected to a high-speed four-ball test in accordance with ASTM D4172-94 at room temperature, rotation speed of 1,800 rpm, and load of 392 N for 30 minutes to measure an average wear scar diameter on the test balls after the test. A wear scar diameter of 0.6 mm or smaller indicates that the composition is excellent in anti-wear properties.

As shown in Table 1, the lubricating oil compositions of the present invention (Examples 1 to 3) were found to be extremely excellent in any of properties evaluated by the above tests, compared with the lubricating oil composition (Comparative Example 1) containing zinc dialkyldithiophosphate, which is a conventional long-drain oil with excellent oxidation stability, base number retention properties and high temperature detergency. Furthermore, the compositions containing an alkylphosphonic acid diester (Example 3) and those containing a zinc salt of an alkylphosphonic acid monoester (Example 1) were found to exhibit more excellent characteristic properties than that containing a dodecyl amine salt of an alkylphosphonic acid monoester (Example 2).

As a result of the high-speed four-ball test, the composition of Example 1 had a wear scar diameter of 0.6 mm or smaller and thus found to exhibit anti-wear properties comparably with the composition of Comparative Example 1.

EXAMPLES 4 AND 5, AND REFERENCE EXAMPLES 1 AND 2

Lubricating oil compositions of the present invention (Examples 4 and 5) and those for comparison (Reference Examples 1 and 2) were prepared as set forth in Table 2 below. The following performance evaluation tests were conducted for each of the resulting compositions. The results are shown in Table 2.

(5) High-Speed Four-Ball Test

Each of the compositions was subjected to a high-speed four-ball test in accordance with ASTM D2783-88 at room temperature and a rotation speed of 1,800 rpm while the load on four balls is constantly increased. The load (LNSL, last non-seize load) at which wear occurred on the balls was measured. A higher LNSL value indicates that the composition is excellent in anti-wear properties and extreme pressure properties.

(6) Changes in Base Number Remaining Rate with Time by ISOT

Each of the compositions was forced to deteriorate at a temperature of 165.5° C. and measured for change in base number remaining rate (hydrochloric acid method) with time by an ISOT test in accordance with JIS K 2514. A higher base number remaining rate against the testing time indicates that the composition is enhanced in base number retention properties and thus is a long drain oil which is able to be used for a long period of time.

As apparent from Table 2, the compositions containing Components (A) and (B) in combination and decreased in sulfur and phosphorus contents to less than 0.01 percent by mass and 0.05 percent by mass, respectively (Examples 4 and 5) were found to be synergistically improved in LNSL and maintain the base number retention properties in a higher level, compared with that containing either Component (A) or (B) alone and decreased in sulfur and phosphorus contents to less than 0.01 percent by mass and 0.05 percent by mass, respectively (Reference Example 1 or 2). Particularly, the composition containing Components (A) and (B) at a mass ratio in terms of phosphorus of 53:47 (Example 5) was remarkably improved in LNSL, compared with that containing Components (A) and (B) at a mass ratio in terms of phosphorus of 26:74 (Example 4). The base number retention properties of the compositions of Examples 4 and 5 were significantly excellent, when compared with a composition containing a sulfur-containing compound such as zinc dithiophosphate which has conventionally been in heavy usage.

The composition of Example 5 was also subjected to a valve train wear test in accordance with JASO M 328-95 (100 hours, a low sulfur gasoline whose sulfur content was 10 ppm by mass or less was used as a fuel) The composition was excellent in anti-scuffing properties for locker arm pads and anti-wear properties for locker arms and cam noses. It was also confirmed that the composition after the test was equivalent or better in practical performances such as base number remaining rate, total oxidation increasing rate, viscosity increasing rate and engine detergency, to or than the composition of Reference Example 2.

TABLE 1

| | | | Example 1 | Example 2 | Example 3 | Comparative Example 1 |
|---|---|---|---|---|---|---|
| Lubricating base oil ※1 | | mass % | 85.5 | 85.1 | 85.3 | 85.3 |
| (A) Zinc salt of phosphonate ※2 | | mass % | 0.9 | — | — | — |
| (A) Amine salt of phosphonate ※3 | | mass % | — | 1.3 | — | — |
| (A) Phosphonate ※4 | | mass % | — | — | 1.1 | — |
| Zinc dialkyldithiophosphate ※5 | | mass % | — | — | — | 1.1 |
| (C) Chain reaction terminator ※6 | | mass % | 1.0 | 1.0 | 1.0 | 1.0 |
| (D) Ashless dispersant ※7 | | mass % | 4.0 | 4.0 | 4.0 | 4.0 |
| (E) Metallic detergent ※8 | | mass % | 3.6 | 3.6 | 3.6 | 3.6 |
| Other additives ※9 | | mass % | 5.0 | 5.0 | 5.0 | 5.0 |
| | | Properties of compositions | | | | |
| Kinematic viscosity | 40° C. | $mm^2/s$ | 64.44 | 62.6 | 66.1 | 67.97 |
| | 100° C. | $mm^2/s$ | 10.66 | 10.56 | 10.74 | 10.96 |
| Acid number | | mgKOH/g | 2.63 | 0.94 | 2.56 | 2.93 |
| Base number (HCl method) | | mgKOH/g | 9.07 | 7.26 | 8.89 | 8.65 |

TABLE 1-continued

| | | | | Example 1 | Example 2 | Example 3 | Comparative Example 1 |
|---|---|---|---|---|---|---|---|
| Element concentration | Ca | | mass % | 0.22 | 0.22 | 0.22 | 0.22 |
| | P | | mass % | 0.08 | 0.08 | 0.08 | 0.08 |
| | Zn | | mass % | 0.09 | 0 | 0 | 0.09 |
| | S | | mass % | <0.01 | <0.01 | <0.01 | 0.18 |
| | N | | mass % | 0.12 | 0.16 | 0.12 | 0.12 |
| Sulfated ash content | | | mass % | 0.86 | 0.73 | 0.73 | 0.86 |
| Results of performance evaluation test on compositions | | | | | | | |
| Hot tube test (best = 10) | 300° C. | | rating | 10 | 10 | 10 | 8 |
| | 310° C. | | rating | 8 | 3 | 8 | 0 |
| | 320° C. | | rating | 2 | 0 | 2 | 0 |
| Base number remaining rate after ISO test | | after 60 hours | % | 71 | 38 | 70 | 29 |
| (HCl method, 165.5° C.) | | after 120 hours | % | 51 | 22 | 38 | 17 |
| Base number remaining rate after NO*x* adsorbing test | | after 10 hours | % | 73 | 48 | 61 | 53 |
| (HCl method, 150° C.) | | after 24 hours | % | 43 | 12 | 22 | 5 |
| High-speed four-ball test (wear scar diameter) | | | mm | 0.52 | — | — | 0.47 |

※1 Hydro-refined mineral oil, kinematic viscosity at 100° C.: 5.3 $mm^2/s$, viscosity index: 120, total aromatics: 5 mass %, sulfur content: 0.001 mass %

※2 Zinc salt of compound of formula (1) wherein $R^1$ and $R^2$ are 2-ethylhexyl and $R^3$ is hydrogen, phosphorus content: 9.2 mass %, zinc content: 9.5 mass %, sulfated ash: 14.2 mass %

※3 Dodecylamine salt of compound of formula (1) wherein $R^1$ and $R^2$ are 2-ethylhexyl and $R^3$ is hydrogen, phosphorus content: 6.3 mass %, nitrogen content: 2.85 mass %

※4 Compound of formula (1) wherein $R^1$, $R^2$ and $R^3$ are 2-ethylhexyl, phosphorus content: 7.4 mass %

※5 Alkyl group: sec butyl/sec hexyl, phosphorus content: 7.2 mass %, sulfur content: 15.2 mass %, zinc content: 7.8 mass %, sulfated ash: 11.7 mass %

※6 Phenol-based and amine-based anti-oxidants (1:1)

※7 Polybutenyl succinimide, nitrogen content: 1.3 mass %, weight average molecular weight: 4,000

※8 Calcium salicylate, calcium content: 6.0 mass %, metal ratio: 2.7, sulfated ash: 20.4 mass %

※9 Viscosity index improver (PMA, OCP), additive containing anti-foaming agent and the like

TABLE 2

| | | | | Example 4 | Example 5 | Reference Example 1 | Reference Example 2 |
|---|---|---|---|---|---|---|---|
| Lubricating base oil | | ※1 | mass % | balance | balance | balance | balance |
| (A) Phosphorus compound A | | ※2 | mass % | 0.15 | 0.30 | — | 0.58 |
| Amount in terms of phosphorus | | | mass % | 0.013 | 0.026 | — | 0.05 |
| (B) Metal salt of phosphorus compound B | | ※3 | mass % | 0.29 | 0.18 | 0.39 | — |
| Amount in terms of phosphorus | | | mass % | 0.037 | 0.023 | 0.05 | — |
| (A):(B) (mass ratio in terms of phosphorus) | | | | 26:74 | 53:47 | 0:100 | 100:0 |
| (C) Chain reaction terminator | | ※4 | mass % | 1.5 | 1.5 | 1.5 | 1.5 |
| (D) Ashless dispersant | | ※5 | mass % | 4.5 | 4.5 | 4.5 | 4.5 |
| (E) Metallic detergent | | ※6 | mass % | 3.0 | 3.0 | 3.0 | 3.0 |
| Other additives | | ※7 | mass % | 4.0 | 4.0 | 4.0 | 4.0 |
| Element consentration | Ca | | mass % | 0.18 | 0.18 | 0.18 | 0.18 |
| | P | | mass % | 0.05 | 0.05 | 0.05 | 0.05 |
| | Zn | | mass % | 0.037 | 0.023 | 0.05 | 0.00 |
| | S | | mass % | <0.01 | <0.01 | <0.01 | <0.01 |
| | N | | mass % | 0.13 | 0.13 | 0.13 | 0.13 |
| Sulfated ash content | | | mass % | 0.7 | 0.7 | 0.7 | 0.6 |
| High-speed four-ball test LSNL | | | N | 618 | 785 | 490 | 490 |
| Base number remaining rate after ISOT | | after 48 hours | % | 54 | 55 | 53 | 54 |
| (165.5° C.) | | after 84 hours | % | 44 | 43 | 44 | 40 |
| | | after 144 hours | % | 32 | 31 | 33 | 30 |

※1 Hydro-refined mineral oil, kinematic viscosity at 100° C.: 4.7 $mm^2/s$, viscosity index: 120, sulfur content 10 mass ppm, % CA: 0.6

※2 Octadecyl phosphoric acid dimetyl ester given below, phosphorus content 8.6 mass %

※3 Zinc salt of phosphoric acid dibutyl ester given below, phosphorous content: 12.8 mass %, zinc content: 12.8 mass %, R: butyl ※4 4,4'-methylene bis-2,6-ditert-butylphenol and dialkyldiphenylamine ※5 Polybutenyl succinimide, nitrogen content: 2.0 mass %, weight average molecular weight: 3,000

※6 Ca salicylate, base number. 170 mgKOH/g, metal ratio: 2.7, calcium content: 6 mass %

TABLE 2-continued

| | Example 4 | Example 5 | Reference Example 1 | Reference Example 2 |
|---|---|---|---|---|

※7 Viscosity index improver (PMA, OCP), additive containing anti-foaming agent and the like

※2

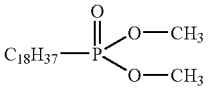

※3

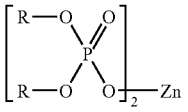

[Applicability in the Industry]

The lubricating oil composition of the present invention is excellent in extreme pressure properties, anti-wear properties, and base number retention properties as well as oxidation stability and anti-corrosion properties. Therefore, the composition is applicable as various lubricating oils required to possess such properties, as described above. Furthermore, the composition can be further improved in high temperature detergency and oxidation stability by properly selecting the type or content of a metallic detergent or an ashless dispersant. The composition can be used as a low sulfur and phosphorus lubricating oil composition whose sulfur and phosphorus contents are decreased to 0.3 percent by mass or less and 0.08 percent by mass or less, respectively. Alternatively, since the sulfate ash content of the composition can be adjusted to a desired level, such as from 0.01 to 1.2 percent by mass, preferably 0.8 percent by mass or less, and more preferably 0.6 percent by mass or less, the composition is useful as a lubricating oil composition for an internal combustion engine, which composition does not deteriorate the purifying performances of exhaust-gas purifying devices (exhausts-gas catalysts such as ternary catalysts, oxidation catalysts, and NOx adsorber and/or diesel particulate filter (DPF)).

Furthermore, the present invention is also useful as a low sulfur and phosphorus engine system for lubricating internal combustion engines using a low sulfur fuel (gas oil, gasoline or gas), using the above-described low sulfur and phosphorus lubricating oil composition and can prolong the maintenance intervals of power-generating engine system such as cogeneration system and automobile engine systems, using a fuel such as a low sulfur gas oil or kerosene whose sulfur content is 50 ppm by mass or less, a sulfur-free gasoline, or an LP gas or natural gas, due. to the lubricating oil with improved long-drain properties.

The invention claimed is:

1. A lubricating oil composition comprising a lubricating base oil, (A) at least one type of compound selected from the group consisting of zinc salts of phosphorus compounds represented by formula (1) below, and (B) at least one type of compound selected from the group consisting of metal salts of phosphorus compounds represented by formulas (2) and (3) below:

(1)

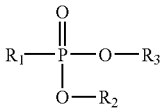

wherein $R_1$ is a hydrocarbon group containing no oxygen or nitrogen, and $R_2$ and $R_3$ are each independently hydrogen or a hydrocarbon group having 8 to 30 carbon atoms, which may contain nitrogen and/or oxygen;

(2)

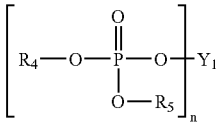

wherein $R_4$ and $R_5$ are each independently a hydrocarbon group having 3 to 30 carbon atoms, which may contain nitrogen and/or oxygen, $Y_1$ is a metal element, and n is an integer corresponding to the valence of $Y_1$;

(3)

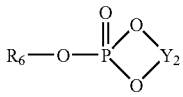

wherein $R_6$ is a hydrocarbon group having 3 to 30 carbon atoms, which may contain nitrogen and/or oxygen, and $Y_2$ is a metal element; and wherein $Y_1$ in formula (2) and $Y_2$ in formula (3) are each independently a metal selected from the group consisting of alkaline earth metals and zinc.

2. The lubricating oil composition according to claim 1 wherein the total content of Components (A) and (B) is 0.08 percent by mass or less in terms of phosphorus.

3. A method of improving oxidation stability and base number retention properties while maintaining enhanced anti-wear properties in an internal combustion engine, comprising lubricating the engine with the lubricating oil composition according to claim 1.

4. The method according to claim 3 wherein said internal combustion engine uses a fuel having a sulfur content of 50 ppm by mass or less.

5. The method according to claim 3 wherein said internal combustion engine is equipped with DPF and/or an exhaust-gas purifying catalyst selected from the group consisting of an oxidation catalyst, a ternary catalyst and a NOx adsorber.

6. A low sulfur and phosphorus long-drain engine system wherein an internal combustion engine using a fuel whose sulfur content is 50 ppm by mass or less is lubricated with a lubricating oil composition comprising a lubricating base oil, Component (A) or in addition thereto Component (B) and containing sulfur in an amount of 0.3 percent by mass or less and phosphorus in an amount of 0.08 percent by mass or less based on the total mass of the composition; wherein Component (A) is at least one type of compound selected from the group consisting of zinc salts of phosphorus compounds represented by formula (1) below, and Component (B) is at least one type of compound selected from the group consisting of metal salts of phosphorus compounds represented by formulas (2) and (3) below:

(1)

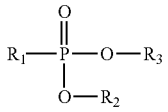

wherein $R_1$ is a hydrocarbon group containing no oxygen or nitrogen, and $R_2$ and $R_3$ are each independently hydrogen or a hydrocarbon group having 8 to 30 carbon atoms, which may contain nitrogen and/or oxygen;

(2)

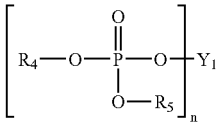

wherein $R_4$ and $R_5$ are each independently a hydrocarbon group having 3 to 30 carbon atoms, which may contain nitrogen and/or oxygen, $Y_1$ is a metal element, and n is an integer corresponding to the valence of $Y_1$;

(3)

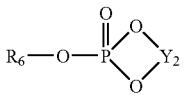

wherein $R_6$ is a hydrocarbon group having 3 to 30 carbon atoms, which may contain nitrogen and/or oxygen, and $Y_2$ is a metal element; and wherein $Y_1$ in formula (2) and $Y_2$ in formula (3) are each independently a metal selected from the group consisting of alkaline earth metals and zinc.

7. The lubricating oil composition according to claim 1 which further comprises (C) a chain reaction terminator.

8. The lubricating oil composition according to claim 1 which further comprises (D) an ashless dispersant and/or (E) a metallic detergent.

9. The lubricating oil composition according to claim 1 which further comprises one or more types of additives selected from the group consisting of anti-wear agents other than Components (A) and (B), friction modifiers, viscosity index improvers, corrosion inhibitors, rust inhibitors, demulsifiers, metal passivators, anti-foaming agents, and dyes.

10. The lubricating oil composition according to claim 1 which contains substantially no zinc dithiophosphate.

11. The lubricating oil composition according to claim 1 wherein the $\%C_A$ and sulfur content of the lubricating base oil are 3 or less and 0.05 percent by mass or less, respectively.

12. A lubricating oil composition comprising a lubricating base oil, (A) at least one type of compound selected from the group consisting of metal salts of phosphorus compounds represented by formula (1) below, and (B) at least one type of compound selected from the group consisting of metal salts of phosphorus compounds represented by formulas (2) and (3) below:

(1)

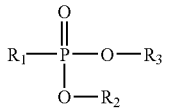

wherein $R_1$ is a hydrocarbon group containing no oxygen or nitrogen, $R_2$ is a hydrocarbon group having 1 to 30 carbon atoms, and $R_3$ is a hydrocarbon group having 5 to 30 carbon atoms, and wherein any of $R_2$, and $R_3$ may contain nitrogen and/or oxygen;

(2)

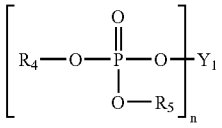

wherein $R_4$ and $R_5$ are each independently a hydrocarbon group having 3 to 30 carbon atoms, which may contain nitrogen and/or oxygen, $Y_1$ is a metal element, and n is an integer corresponding to the valence of $Y_1$;

(3)

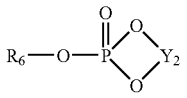

wherein $R_6$ is a hydrocarbon group having 3 to 30 carbon atoms, which may contain nitrogen and/or oxygen, and $Y_2$ is a metal element; and wherein $Y_1$ in formula (2) and $Y_2$ in formula (3) are each independently a metal selected from the group consisting of alkaline earth metals and zinc.

* * * * *